US008955781B2

(12) United States Patent
Sato

(10) Patent No.: US 8,955,781 B2
(45) Date of Patent: Feb. 17, 2015

(54) APPARATUS FOR FRACTURING AND METHOD FOR PRODUCING FRACTURED FRAGMENTS

(71) Applicant: Mitsubishi Materials Corporation, Tokyo (JP)

(72) Inventor: Motoki Sato, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 207 days.

(21) Appl. No.: 13/652,664

(22) Filed: Oct. 16, 2012

(65) Prior Publication Data

US 2013/0099032 A1 Apr. 25, 2013

(30) Foreign Application Priority Data

Oct. 21, 2011 (JP) ..... 2011-231974

(51) Int. Cl.

| | |
|---|---|
| ***B02C 23/00*** | (2006.01) |
| ***B02C 13/09*** | (2006.01) |
| ***B02C 13/20*** | (2006.01) |
| ***B02C 4/08*** | (2006.01) |
| ***B02C 4/30*** | (2006.01) |

(52) U.S. Cl.

CPC .... *B02C 4/08* (2013.01); *B02C 4/30* (2013.01)
USPC ..... 241/295; 241/189.1; 241/235

(58) Field of Classification Search

USPC ..... 241/294, 295, 235, 236, 300, 189.1, 241/187, 191
See application file for complete search history.

(56) References Cited

U.S. PATENT DOCUMENTS

| | | | | | |
|---|---|---|---|---|---|
| 3,412,946 | A * | 11/1968 | Gabler et al. | ..... | 241/293 |
| 4,617,709 | A * | 10/1986 | Gundlach | ..... | 241/293 |
| 5,704,561 | A * | 1/1998 | Ansen et al. | ..... | 241/293 |
| 6,086,003 | A * | 7/2000 | Gunter et al. | ..... | 241/235 |
| 6,094,795 | A * | 8/2000 | Davenport | ..... | 29/407.1 |
| 7,198,209 | B2 * | 4/2007 | Herbst | ..... | 241/30 |
| 7,950,600 | B2 | 5/2011 | Gruebl et al. | | |
| 8,240,589 | B2 * | 8/2012 | Sommer et al. | ..... | 241/295 |

FOREIGN PATENT DOCUMENTS

| | | | |
|---|---|---|---|
| JP | 2006-122902 | A | 5/2006 |
| JP | 2006-192423 | A | 7/2006 |
| JP | 2009-531172 | A | 9/2009 |

* cited by examiner

*Primary Examiner* — Faye Francis
(74) *Attorney, Agent, or Firm* — Edwards Wildman Palmer LLP

(57) ABSTRACT

An apparatus for fracturing in which: a fracturing tooth is formed so as to have a larger base part than a top end; a fixing cover is formed along a longitudinal direction of rolls and is provided with fixing holes for fracturing teeth arranged along the longitudinal direction, expanded parts which are formed by expanding both sides of the fixing holes, and an indented part which is formed by narrowing a part between the fixing holes with respect to the expanded parts; the base part of the fracturing tooth is held between the roll and the fixing cover fixed on the roll and the indented part and the expanded part of the adjacent fixing cover are engaged with each other in fracturing teeth unit, so that the fracturing teeth are arranged in a staggered manner.

3 Claims, 6 Drawing Sheets

APPARATUS FOR FRACTURING AND METHOD FOR PRODUCING FRACTURED FRAGMENTS

CROSS REFERENCE TO RELATED APPLICATIONS

This application is related to co-pending application: "APPARATUS FOR FRACTURING AND METHOD FOR PRODUCING FRACTURED FRAGMENTS" filed even date herewith in the names of Motoki Sato and Ryusuke Tada, which claims priority to Japanese App. No. 2011-231975, filed Oct. 21, 2011; which application is assigned to the assignee of the present application and is incorporated by reference herein.

BACKGROUND OF THE INVENTION

1. Field of the Invention

The present invention relates town apparatus for fracturing object into desired size and a method for producing fractured fragments using the same.

Priority is claimed on Japanese Patent Application No. 2011-231974, filed Oct. 21, 2011, the content of which is incorporated herein by reference.

2. Description of Related Art

According to characters of fracturing objects, various apparatuses for fracturing are proposed. For example, in order to fracture polycrystalline silicon for manufacturing single-crystal silicon, apparatuses for fracturing described in the following patent documents 1 to 3 are used:

Patent document 1: Japanese Unexamined Patent Application, First Publication No. 2006-122902

Patent document 2: Published Japanese Translation No. 2009-531172 of the PCT International Publication Patent document 3: Japanese Unexamined Patent Application, First Publication No. 2006-192423

In the patent document 1, a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

On the other hand, in the patent documents 2 and 3, apparatuses for fracturing roughly-crashed fragments of polycrystalline silicon are proposed. These apparatuses are double-roll crashers having two rolls and crashing the roughly-crashed fragments of polycrystalline silicon between the rolls.

SUMMARY OF THE INVENTION

Problems to be Solved by the Invention

A maximum target size of fractured fragments obtained from the roll crasher is set as a gap between the roll and the inner surface of the housing of the roll crasher in the patent document 1 or a gap between the rolls of the roll crashers in the patent documents 2 and 3, so that the fracturing object can be fractured into desired size efficiently.

However, since polycrystalline silicon is rigid as a fracturing object, there is a case in which fracturing teeth may be chipped, worn, or broken, so that maximum target size of the fracturing object cannot be controlled and a fracturing efficiency of polycrystalline silicon fracturing into desired size is deteriorated. Furthermore, impurity is generated by an abrasion of the fracturing teeth and immixed into fractured fragments of polycrystalline silicon, thereby causing contamination and acting the quality of the fractured fragments.

The present invention is contrived in view of the circumstances, and an object of the present invention is to provide an apparatus for fracturing and a method for producing fractured fragments using the apparatus for fracturing which can prevent chipping and wearing of the fracturing teeth, obtain high-quality fractured fragments, and control the fractured fragments obtained by fracturing objects at desired size.

Means for Solving the Problem

An apparatus for fracturing according to the present invention includes: a pair of rolls which are rotated in a counter direction each other around parallel axes; and a plurality of fracturing teeth units which are provided on outer peripheral surfaces of the rolls, which are arranged along a circumferential direction of the rolls, and which have a plurality of fracturing teeth protruding radially-outwardly and fixing covers fixing the fracturing teeth on the outer peripheral surfaces of the rolls: each of the fracturing teeth is formed so that a base part has a larger diameter than that of a top end; the fixing cover is formed long along a longitudinal direction of the rolls, provided with: a plurality of fixing holes for fracturing teeth penetrating a thickness of the fixing cover and being arranged along the longitudinal direction; expanded parts which are formed by expanding side edges of both side parts of the fixing holes for fracturing teeth; and an indented part which is formed by narrowing a part between the fixing holes for fracturing teeth with respect to the expanded part; the fracturing teeth unit is fixed to the roll in a state in which the top end of the fracturing tooth is protruded from the fixing hole for fracturing tooth radially-outwardly of the roll and a vicinity of the base end of the fracturing tooth is wedged between the roll and the fixing cover; and the fracturing teeth unit attaches the fracturing teeth in a staggered arrangement so that the fracturing teeth of the adjacent fracturing teeth units are not rowed along a circumferential direction of the rolls by engaging the indent part of one of the fracturing teeth units with the expanded parts of the other fracturing teeth units adjacent each other, so that the apparatus fractures fracturing objects between the rolls.

In this apparatus for fracturing, fracturing objects can be fractured efficiently by continuously being impacted by the fracturing teeth while rolling the rolls. In this case, each of the fracturing teeth is formed so that the base part has the larger diameter than that of the top end thereof. Therefore, the fracturing teeth are improved in strength at the contact regions with the fixing cover.

In the fixing cover, the expanded part is formed by expanding the side edges of both the side parts of the fixing hole holding periphery of the base part of the fracturing tooth having the large diameter. The adjacent fixing covers are fitted with each other by engaging the indented part which is formed between the expanded parts of the fixing cover with the expanded parts of the other fixing cover, so that the fracturing teeth are arranged in the staggered manner. Therefore, since contact surfaces between the adjacent fixing covers are formed in a saw-toothed shape along the longitudinal direction of the fixing covers, the contact area is large so that the fixing covers are supported to each other. As a result, the fixing covers are prevented from being deformed even when the fracturing teeth are loaded.

Furthermore, since the expanded part is formed wide along the circumferential direction of the roll, the fracturing tooth is prevented from being bent or shaken, so that uniformly-sized fractured fragments can be stably produced.

Moreover, by arranging the fracturing teeth in the staggered manner, even though the fracturing tooth is formed so as to be radially expanded at the base part thereof, the fracturing teeth can be arranged without expanding a pitch along the circumferential direction of the roll, so that the fractured fragments obtained by fracturing the fracturing object can be controlled in desired size.

In the apparatus for fracturing according to the present invention, it is preferable that both ends of the fixing cover of the fracturing teeth unit be fixed to the roll by screws, and a flat part be formed on the outer peripheral surface of the roll in which back surfaces of the both ends of the fixing cover are in contact with.

If the outer peripheral surface of the roll at the fixing part of the screws for the fixing cover is formed cylindrical, bending stress is generated on the screws fixing the fixing cover. However, since the fixing cover and the roll are in contact at surfaces, the fixing cover is stabilized and the breakage or the like thereof can be prevented.

A method for producing fractured fragments according to the present invention produces the fractured fragments by using the apparatus for fracturing described above.

Effects of the Invention

According to the present invention, even though the fracturing tooth is formed so as to be radially expanded at the base part thereof, the fracturing teeth can be arranged without expanding the pitch along the circumferential direction of the roll, so that the fracturing object can be fractured efficiently. Therefore, the fracturing tooth can be prevented from being worn away and high-quality fractured fragments can be obtained. Furthermore, the fractured fragments obtained by fracturing the fracturing object can be controlled in desired size.

DESCRIPTION OF THE PREFERRED EMBODIMENTS

Hereinafter, an apparatus for fracturing and a method for producing fractured fragments according to the present invention will be described with reference to the drawings in respect of an apparatus for fracturing polycrystalline silicon and a method for producing fractured fragments of polycrystalline silicon.

Figure 1:
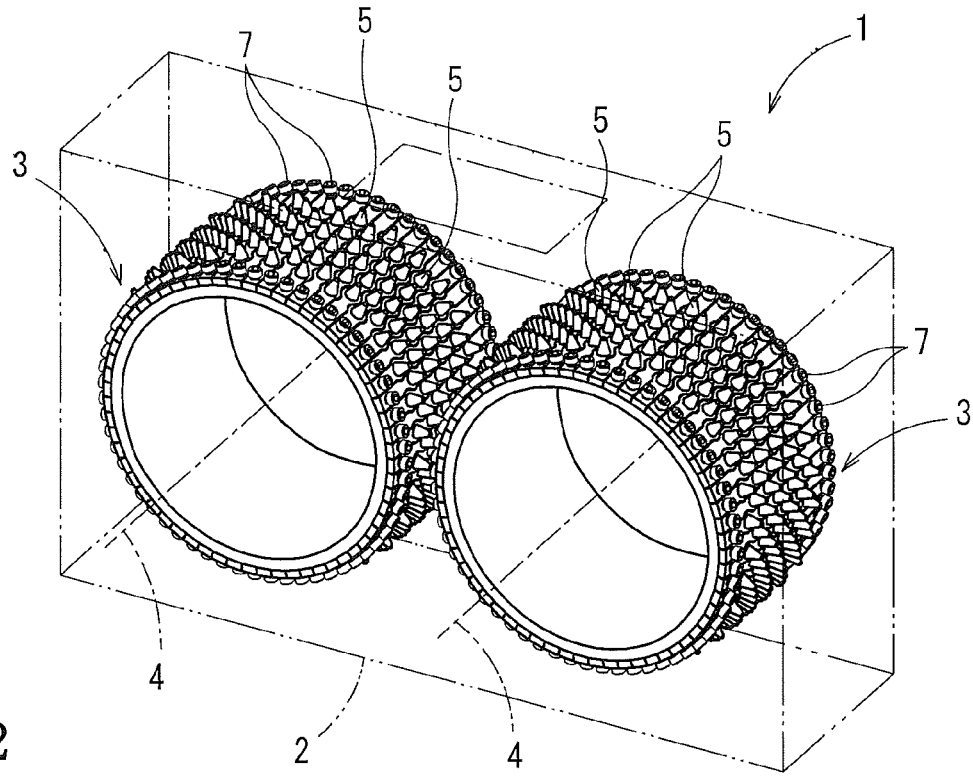
FIG. 1 is a perspective view showing an embodiment of an apparatus for fracturing according to the present invention.
Figure 2:
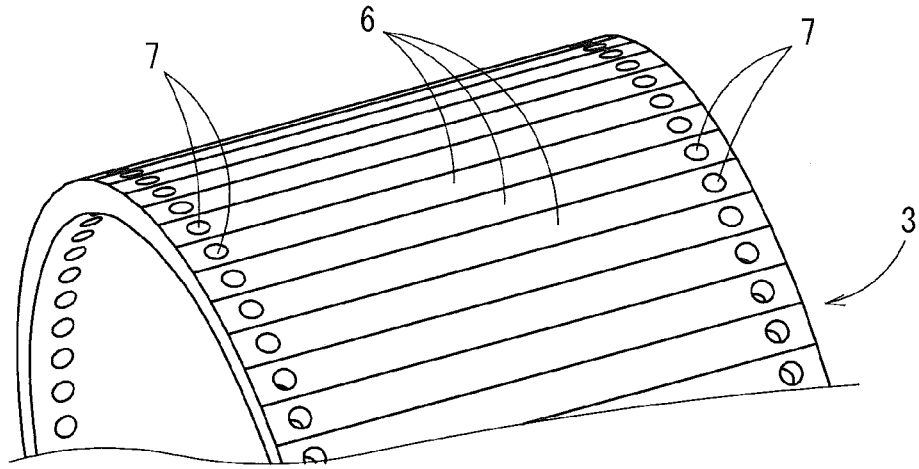
FIG. 2 is a perspective view showing a surface of a roll in the apparatus for fracturing shown in FIG. 1.

As shown in FIG. 1, an apparatus 1 for fracturing polycrystalline silicon (hereinafter, "the fracturing apparatus 1") of the present embodiment is provided with two rolls 3 which are arranged in a housing 2 so that axes 4 are horizontal and parallel with each other. A plurality of fracturing teeth 5 are provided on an outer peripheral surface of both the rolls 3 so as to protruding radially-outwardly. As shown in FIG. 2, the outer peripheral surface of the rolls 3 are not even circular surface, but are formed as a polyhedral shape configured from long flat parts 6 which are elongated along the axis direction and are connected along a circumferential direction. Threaded holes 7 are formed at both ends of the flat part 6. On each of the flat parts 6, a fracturing teeth unit 8 is fixed.

Figure 3:
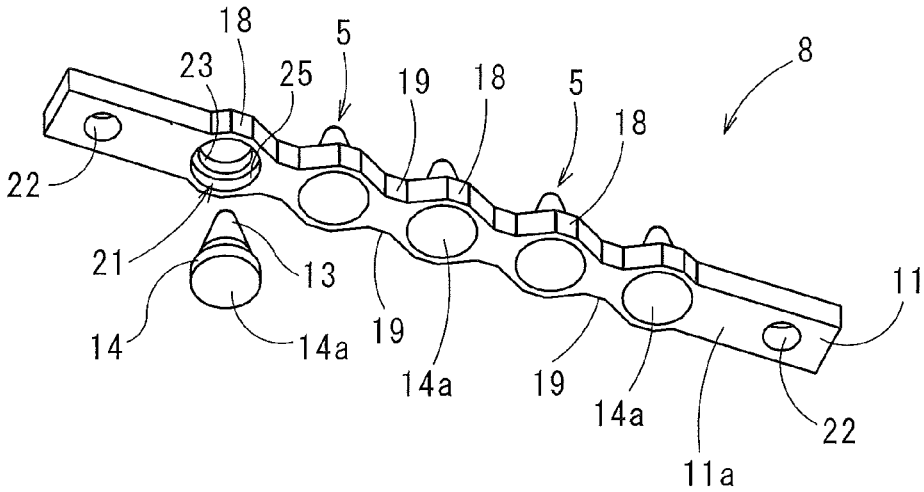
FIG. 3 is a perspective view showing a fracturing teeth unit viewed from a back side, which is attached to the apparatus for fracturing.
Figure 4:
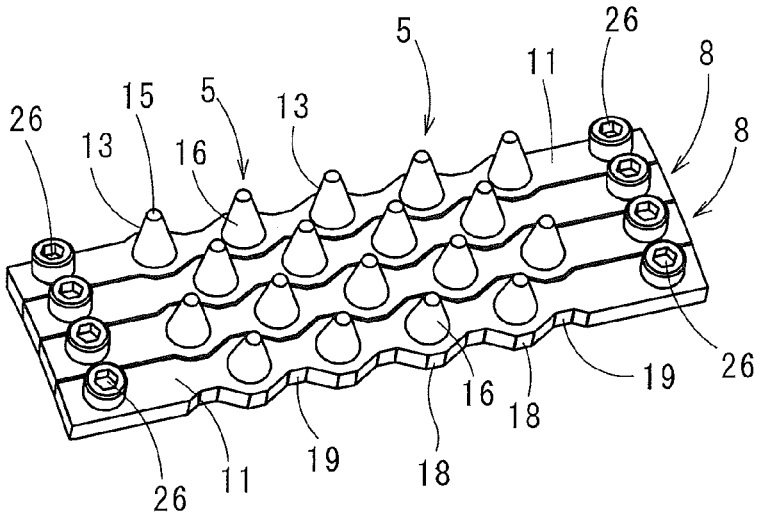
FIG. 4 is a perspective view showing the fracturing teeth units which are arranged.

The fracturing teeth unit 8 is provided with a long fixing cover 11 which is in contact with the flat part 6 of the roll 3, and the plurality of fracturing teeth 5 which are fixed to the fixing cover 11 as shown in FIG. 3 and FIG. 4.

Figure 5:
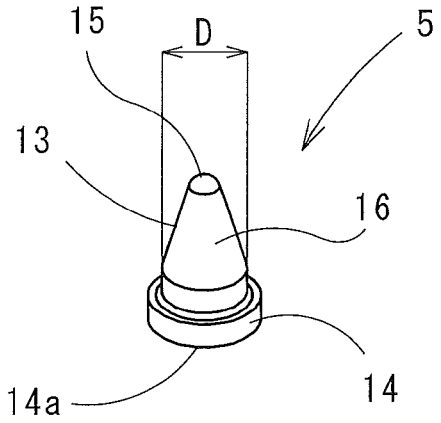
FIG. 5 is a perspective view showing a fracturing tooth.

The fracturing tooth 5 is formed as a unit from cemented carbide or silicon material, and has a column part 13 and a flange 14 which expands in diameter at a base part of the column part 13 as shown in FIG. 5. In the column part 13, a base part of a side surface 16 is formed cylindrically, and a top part which is connected with a spherical top surface 15 is formed conically. An end surface 14*a* of the flange 14 is formed as a flat plane orthogonal to the longitudinal direction of the fracturing tooth 5.

Figure 6:
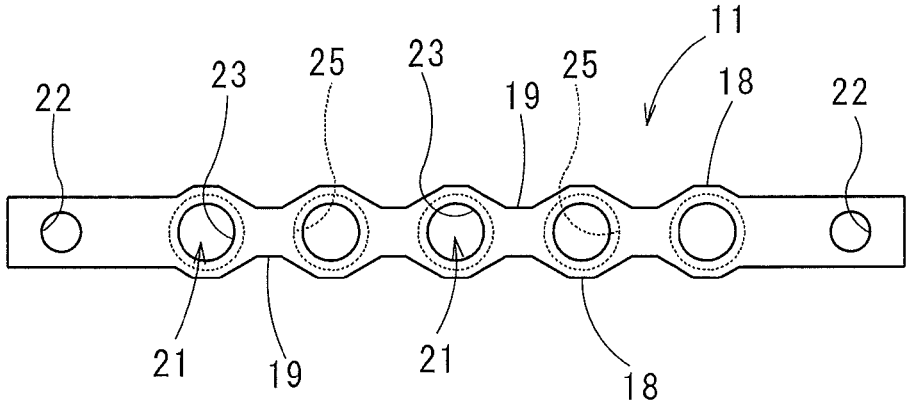
FIG. 6 is a front view showing a fixing cover of the fracturing teeth unit.

The fixing cover 11 is formed long having the same width and the same length as that of the flat part 6 of the roll 3. In the fixing cover 11, as shown in FIG. 6, a plurality of fixing holes 21 for fracturing teeth are formed with intervals along the longitudinal direction of the fixing cover 11 so as to penetrate the fixing cover 11, expanded parts 18 are formed by expanding side edges of both side parts of the fixing hole 21 for fracturing tooth, and an indented part 19 is formed by narrowing a part between the fixing holes 21 for fracturing teeth with respect to the expanded part 18. Through-holes 22 for screw are formed at both sides of the fixing cover 11.

In the fixing cover 11 shown in FIG. 6, side surfaces of the expanded parts 18 and the indented parts 19 are formed parallel to the longitudinal direction of the fixing cover 11, and are gradually connected with each other.

As shown in FIG. 3, the fixing hole 21 for fracturing tooth is formed so that a half depth thereof is a fitting hole 23 corresponding to the side surface 16 of the column part 13 of the fracturing tooth 5 and having a circular shape at a cross section, and the other half depth thereof is an expanded hole 25 corresponding to the flange 14. Accordingly, the fracturing tooth 5 is held in a state in which the column part 13 is fitted into the fitting hole 23 and the flange 14 is fitted into the expanded hole 25.

In this case, the fixing cover 11 is mounted on each of the flat parts 6 of the roll 3 with setting the expanded hole 25 toward the surface of the roll 3 and is fixed on the surface of the roll 3 at the both ends by screws 26, so that the column part 13 of the fracturing tooth 5 is protruded from the fitting hole 23 and the flange 14 of the fracturing tooth 5 is held between the surface of the roll 3 and the fixing cover 11. In this state, the end surface 14*a* of the flange 14 of the fracturing tooth 5 is in contact at a surface with the flat part 6 of the outer peripheral surface of the roll 3; and a flat back surface 11*a* is also in contact at a surface with the flat part 6 of the roll 3.

The fracturing teeth units 8 are arranged in a staggered manner so that the fracturing teeth 5 of the adjacent fracturing teeth units 8 are not rowed along the circumferential direction of the roll 3, as shown in FIG. 4. The fracturing teeth units 8 is attached so that the indented part 19 formed at the fixing cover 11 is engaged to the expanded part 18 of the adjacent fixing cover 11.

Figure 7:
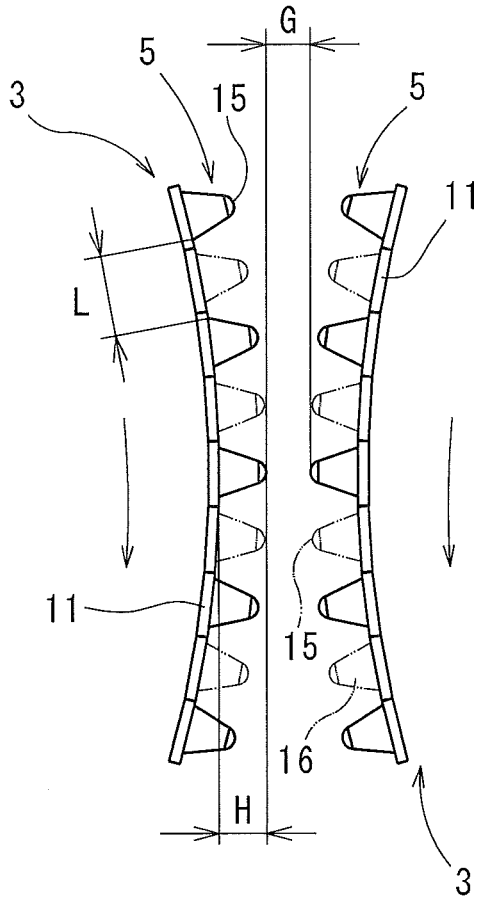
FIG. 7 is a front view showing a positional relation of rolls at a facing part.

On the other hand, as shown in FIG. 7, the rolls 3 are arranged so that the top surfaces 15 of the fracturing teeth 5 on each of the rolls 3 face each other at the facing part of the rolls 3 (i.e., the fracturing teeth 5 of each rolls 3 are closest approached with each other).

In FIG. 7, among the staggered fracturing teeth 5, the fracturing teeth 5 arranged in a same circumferential row are denoted by continuous lines, and the fracturing teeth 5 arranged in the other circumferential row are denoted by two-dot lines.

In this embodiment, target size of fragment of polycrystalline silicon after fracturing is set in a range of 5 mm to 60 mm in maximum length. In order to obtain the fragments of such size, a diameter D of the column part 13 of the fracturing tooth 5 is set in a range of 10 mm to 16 mm, a protruding height H of the fracturing tooth 5 from the surface of the fixing cover 11 to the tip of the fracturing tooth 5 shown in FIG. 7 is set in a range of 15 mm to 25 mm, and a gap L between the adjacent fracturing tooth 5 is set in a range of 14 to 35 mm. Also, at the facing part of the rolls 3, a facing distance G between the top surfaces 15 of the fracturing teeth 5 is set in a range of 5 mm to 30 mm.

The housing 2 in which the rolls 3 are set is formed of resin such as polypropylene or the like, or formed of metal having an inner coating of tetrafluoroethylene in order to prevent contamination.

When fractured fragments of polycrystalline silicon is produced by using the fracturing apparatus 1 configured as described above, in a state of rolling the rolls 3, by supplying roughly-fractured polycrystalline silicon of appropriate size between the rolls 3, the fragments of polycrystalline silicon are further fractured into fragments between the fracturing teeth 5 of the rolls 3.

The fracturing tooth 5 is formed so as to have the larger diameter at the base part (i.e., the flange 14) than at the top end, so that the strength at the contact region with the fixing cover 11 is increased. Furthermore, the expanded part 18 is formed by expanding the side edges of both the side parts of the fixing hole 21 for fracturing tooth in the fixing cover 11. The indented part 19 formed between the expanded parts 18 is engaged with the expanded part 18 of the adjacent fixing cover 11, then the contact surfaces between the adjacent fixing covers 11 are formed in a saw-toothed shape along the longitudinal direction of the fixing covers 11, the contact area is large so that the fixing covers 11 are supported to each other. As a result, the fracturing teeth 5 are prevented from being wasted or the fixing covers 11 are prevented from being deformed even when the fracturing teeth 5 are loaded.

The fracturing tooth 5 is in contact at the end surface 14*a* with the flat part 6 of the roll 3, so that the impact by fracturing can be received at the whole contact surface, and the fracturing tooth 5 is necessarily stable. Therefore, the fracturing tooth 5 is prevented from being shaken, so that uniformly-sized fractured fragments can be stably produced.

Since the back surface 11*a* of the fixing cover 11 is in contact at a surface with the flat part 6 of the roll 3, also the fixing cover 11 is prevented from being shaken by the impact of the fracturing teeth 5. Therefore, bending moment or the like does not act on the screws 26 fixing the fixing cover 11 to the roll 3, so that strong fixation structure can be maintained, and the fixing cover 11 can be prevented from breakage or the like.

The expanded part 18 of the fixing cover 11 is formed wide along the circumferential direction of the roll 3, so that the fracturing teeth 5 fall hard and are prevented from being shaken and the uniformly-sized fractured fragments can be stably produced.

Furthermore, by arranging the fracturing teeth 5 in the staggered manner, even though the fracturing tooth 5 is formed so as to be radially expanded at the base part thereof, the fracturing teeth 5 can be arranged without expanding the pitch along the circumferential direction of the roll 3, and the fractured fragments obtained by fracturing the fracturing object can be controlled in desired size.

In the fracturing teeth 5, the top surfaces 15 are formed spherically, so that the top surfaces 15 and polycrystalline silicon are in contact at points. Also, in the fracturing teeth 5, the side surfaces 16 of the column parts 13 are formed cylindrically, so that the side surfaces 16 and polycrystalline silicon are in contact at points or in lines. Therefore, the fracturing teeth 5 impact polycrystalline silicon by being in contact with polycrystalline silicon at points or in lines, so that polycrystalline silicon can be prevented from being crushed by planes.

Furthermore, in the fracturing apparatus 1, since the fracturing teeth 5 are formed from cemented carbide or silicon material, impurities are prevented from contaminating polycrystalline silicon from the fracturing teeth 5. Moreover, the housing 2 is made from resin such as polypropylene or the like, or is coated by tetrafluoroethylene. Therefore, polycrystalline silicon can be prevented from being contaminated by impurities while fracturing. As a result, according to the fracturing apparatus 1, high-quality polycrystalline silicon for semiconductor material can be obtained.

Furthermore, in the present embodiment, the fracturing teeth units 8 in which the fixing cover 11 holds the fracturing teeth 5 independently with each other are fixed on the surface of the rolls 3. Therefore, when some fracturing teeth 5 are fallen or chip away, it is sufficient to replace the defective fracturing teeth 5. In this case, since the fracturing teeth units 8 are fixed to the rolls 3 by the screws 26, and the fracturing teeth 5 are only fitted into the fixing holes 21 for fracturing teeth of the fixing cover 11 and wedged between the fixing cover 11 and the surface of the roll 3, it is easy to replace some of the fracturing teeth 5.

It is preferable that the fixing cover 11 be made of stainless steel or the like in order to maintain strength. Also, by coating the surface of the fixing cover 11 by resin such as polypropylene, tetrafluoroethylene or the like, contamination can be prevented even though a surface of the fixing cover 11 is in contact with polycrystalline silicon.

Figure 8:
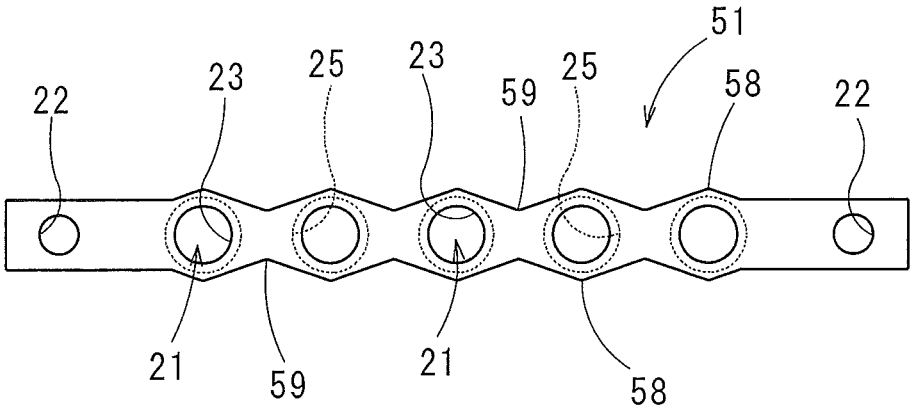
FIG. 8 is a front view showing a modified example of the fixing cover of the fracturing teeth unit.

A fixing cover 51 shown in FIG. 8 is a modified example of the fixing cover 11 of the fracturing teeth unit 8. As in the fixing cover 51 in FIG. 8, an expanded part 58 can be formed only of inclined planes without a flat part. Accordingly, an indented part 59 can be formed only of inclined planes as a gap. Note that, the parts in FIG. 8 which are the same as in FIGS. 1 to 7 are denoted by the same symbols.

The present invention is not limited to the above-described embodiments and various modifications may be made without departing from the scope of the present invention.

For example, the top surfaces of the fracturing teeth are faced each other at the facing part of the rolls in the above embodiment. However, the fracturing teeth of the roll may be arranged so as to be faced to gaps between the fracturing teeth of the other roll.

Figure 9A:
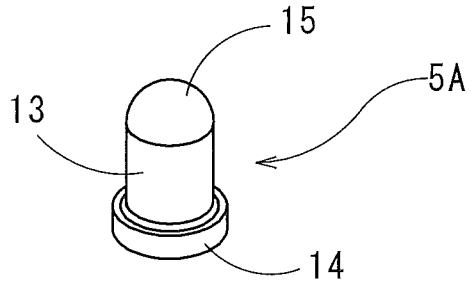
FIGS. 9A to 9C are perspective views showing other embodiments of the fracturing teeth.
Figure 9B:
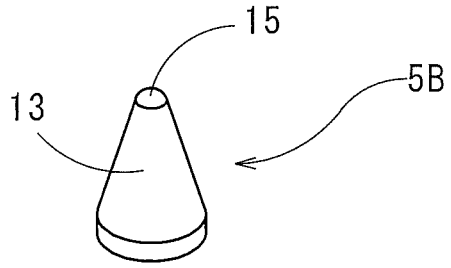
Figure 9C:
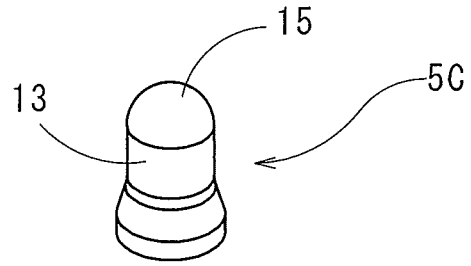

Also, dimensions of the facing gaps or the like of the fracturing teeth are not limited to the above-described embodiments. The flange 14 is formed at the base part of the fracturing tooth 5 and the side surface of the column part 13 of the fracturing tooth 5 is formed so as to have the cylindrical shape at the base part and the conical shape at the top part which is connected with the spherical-top surface 15 in the above embodiment. However, a fracturing tooth 5A having the column part 13 which is formed as cylindrical shape (FIG. 9A), or a fracturing tooth 5B having the column part 13 which is formed as a conical shape from the base part to the top part thereof without a flange (FIG. 9B) may be used. Furthermore, a fracturing tooth 5C having the column part 13 as a combined shape of a conical-base part and a cylindrical-top part.

The fracturing apparatus of the present invention is not limited for fracturing polycrystalline silicon, but can be applied for fracturing plastics, glass or the like.

What is claimed is:

1. An apparatus for fracturing comprising:

a pair of rolls which are rotated in a counter direction each other around parallel axes; and a plurality of fracturing teeth units which are provided on outer peripheral surfaces of the rolls, which are arranged along a circumferential direction of the rolls, and which have a plurality of fracturing teeth protruding radially-outwardly and fixing covers fixing the fracturing teeth on the outer peripheral surfaces of the rolls, wherein each of the fracturing teeth is formed so that a base part has a larger diameter than that of a top end, each of the fixing covers is formed long along a longitudinal direction of the rolls, provided with: a plurality of fixing holes for fracturing teeth penetrating a thickness of each of the fixing covers and being arranged along the longitudinal direction; expanded parts which are formed by expanding side edges of both side parts of the fixing holes for fracturing teeth; and an indented part which is formed by narrowing a part between the fixing holes for fracturing teeth with respect to the expanded parts, the fracturing teeth unit is fixed to the roll in a state in which the top end of the fracturing tooth is protruded from the fixing hole for fracturing tooth radially-outwardly of the roll and a vicinity of the base end of the fracturing tooth is wedged between the roll and each of the fixing covers, and the fracturing teeth unit attaches the fracturing teeth in a staggered arrangement so that the fracturing teeth of adjacent fracturing teeth units are not rowed along a circumferential direction of the rolls by engaging the indent part of one of the fracturing teeth units with the expanded part of the other fracturing teeth units adjacent each other, the apparatus fractures fracturing objects between the rolls.

2. The apparatus for fracturing according to claim 1, wherein:

both ends of each of the fixing covers of the fracturing teeth unit are fixed to the roll by screws; and a flat part is formed on the outer peripheral surface of the roll in which back surfaces of the both ends of each of the fixing covers are in contact with.

3. A method for producing fractured fragments by using the apparatus for fracturing according to claim 1.

* * * * *